US011400580B2

(12) United States Patent
Miley et al.

(10) Patent No.: US 11,400,580 B2
(45) Date of Patent: Aug. 2, 2022

(54) ACCESSORY CASE WITH ATTACHMENT LOOP

(71) Applicant: APEX BRANDS, INC., Apex, NC (US)

(72) Inventors: Chad Aaron Miley, Camden, OH (US); Brandon Rowlan Stumpf, Parkville, MD (US); Eric Jon Van Fossen, Huntersville, NC (US)

(73) Assignee: APEX BRANDS, INC., Apex, NC (US)

( * ) Notice: Subject to any disclaimer, the term of this patent is extended or adjusted under 35 U.S.C. 154(b) by 142 days.

(21) Appl. No.: 16/721,973

(22) Filed: Dec. 20, 2019

(65) Prior Publication Data

US 2020/0198119 A1 Jun. 25, 2020

Related U.S. Application Data

(60) Provisional application No. 62/782,395, filed on Dec. 20, 2018.

(51) Int. Cl.
*B25H 3/00* (2006.01)
*B25H 3/02* (2006.01)

(52) U.S. Cl.
CPC ..... *B25H 3/003* (2013.01); *B25H 3/021* (2013.01)

(58) Field of Classification Search
CPC ..... B25H 3/003; B25H 3/021; B25H 3/02
USPC ..... 206/379, 373
See application file for complete search history.

(56) References Cited

U.S. PATENT DOCUMENTS

| | | | | |
|---|---|---|---|---|
| 6,976,579 | B2 * | 12/2005 | Molnar | A45C 11/24 206/308.1 |
| D547,103 | S * | 7/2007 | Huang | D6/407 |
| D914,603 | S * | 3/2021 | Wang | D13/118 |
| 2004/0035748 | A1 * | 2/2004 | Hernandez, Jr. | B25H 3/003 206/748 |
| 2004/0188287 | A1 * | 9/2004 | Molnar | A45C 11/24 206/311 |
| 2005/0178686 | A1 * | 8/2005 | Pangerc | B25H 3/003 206/379 |
| 2006/0065557 | A1 * | 3/2006 | Brunson | B25H 3/021 206/273 |
| 2006/0186007 | A1 * | 8/2006 | Dost | B25H 3/003 206/379 |
| 2007/0175791 | A1 * | 8/2007 | Watts | A45C 15/00 206/581 |
| 2008/0149678 | A1 * | 6/2008 | Huang | B25H 3/003 224/666 |
| 2009/0152150 | A1 * | 6/2009 | Kernodle, Jr. | B25H 3/003 206/379 |

(Continued)

*Primary Examiner* — Ernesto A Grano
(74) *Attorney, Agent, or Firm* — Burr & Forman LLP

(57) ABSTRACT

A case for storing drivable components or tool accessories may include a first half shell configured to retain drivable components or tool accessories, a second half shell, a hinge and an arm member. The hinge may operably couple the first half shell to the second half shell to enable the first and second half shells to pivot about an axis of the hinge to transition the case between an opened state and a closed state. The arm member may extend away from a portion of only one of the first or second half shell to form a case attachment loop. The case attachment loop may be disposed to enable the transition between the opened and closed states while a suspending device is passed through the case attachment loop.

17 Claims, 5 Drawing Sheets

(56) References Cited

U.S. PATENT DOCUMENTS

| | | | | |
|---|---|---|---|---|
| 2014/0159645 | A1* | 6/2014 | Wyskiel | H02J 7/342<br>320/107 |
| 2016/0052125 | A1* | 2/2016 | Steele | B25H 3/021<br>206/372 |
| 2018/0029201 | A1* | 2/2018 | Feuerstein | B25B 23/0021 |
| 2018/0319006 | A1* | 11/2018 | Jenkins | B25H 3/02 |
| 2019/0191839 | A1* | 6/2019 | Aquino | B25H 3/02 |
| 2019/0283234 | A1* | 9/2019 | Ko | B25H 3/025 |
| 2020/0324399 | A1* | 10/2020 | Christen | B25H 3/003 |
| 2021/0085047 | A1* | 3/2021 | Wright | A45C 13/02 |

* cited by examiner

ACCESSORY CASE WITH ATTACHMENT LOOP

CROSS REFERENCE TO RELATED APPLICATION

This application claims priority to U.S. application No. 62/782,395 filed Dec. 20, 2018, the entire contents of which are hereby incorporated by reference in its entirety.

TECHNICAL FIELD

Example embodiments generally relate to hand tools and, in particular, relate to a case for accessories for a hand tool, where the case has an attachment loop.

BACKGROUND

Drivable components such as drill bits, drivers and/or the like, have long been sold in sets that include different shapes and sizes. These sets would typically be sold in, or otherwise be capable of storage in cases that were made large enough to handle the entire set. The cases may generally be both transportable and suitable for storage (e.g., in a tool chest or other storage container). However, transportation of such cases is typically not possible with any means that can allow simultaneous access to the inside of the case while the case is being suspended by a transporting device. To the contrary, the cases are typically transported in pockets or by suspension means that otherwise render the case unable to be opened.

Thus, it may be desirable to provide a new design for cases to enable simultaneous access while the case is being transported or suspended.

BRIEF SUMMARY OF SOME EXAMPLES

In an example embodiment, a case for storing drivable components or tool accessories is provided. The case may include a first half shell configured to retain drivable components or tool accessories, a second half shell, a hinge and an arm member. The hinge may operably couple the first half shell to the second half shell to enable the first and second half shells to pivot about an axis of the hinge to transition the case between an opened state and a closed state. The arm member may extend away from a portion of only one of the first or second half shell to form a case attachment loop. The case attachment loop may be disposed to enable the transition between the opened and closed states while a suspending device is passed through the case attachment loop.

In another example embodiment, a case for storing components may be provided. The case may include a first half shell having a first side on an exterior portion of the first half shell, a second half shell, a hinge, and a case attachment loop. At least one of the first half shell and the second half shell may be configured to retain components. The hinge may operably couple the first half shell to the second half shell to enable the first and second half shells to pivot about an axis of the hinge to transition the case between an opened state and a closed state. The hinge may be disposed on the first side. The case attachment loop may be coupled to or be integral with the first half shell. The case attachment loop may be disposed on the first side. The case attachment loop may be disposed at a first end of the first side and further wherein the length of the hinge is less than the length of the first side.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
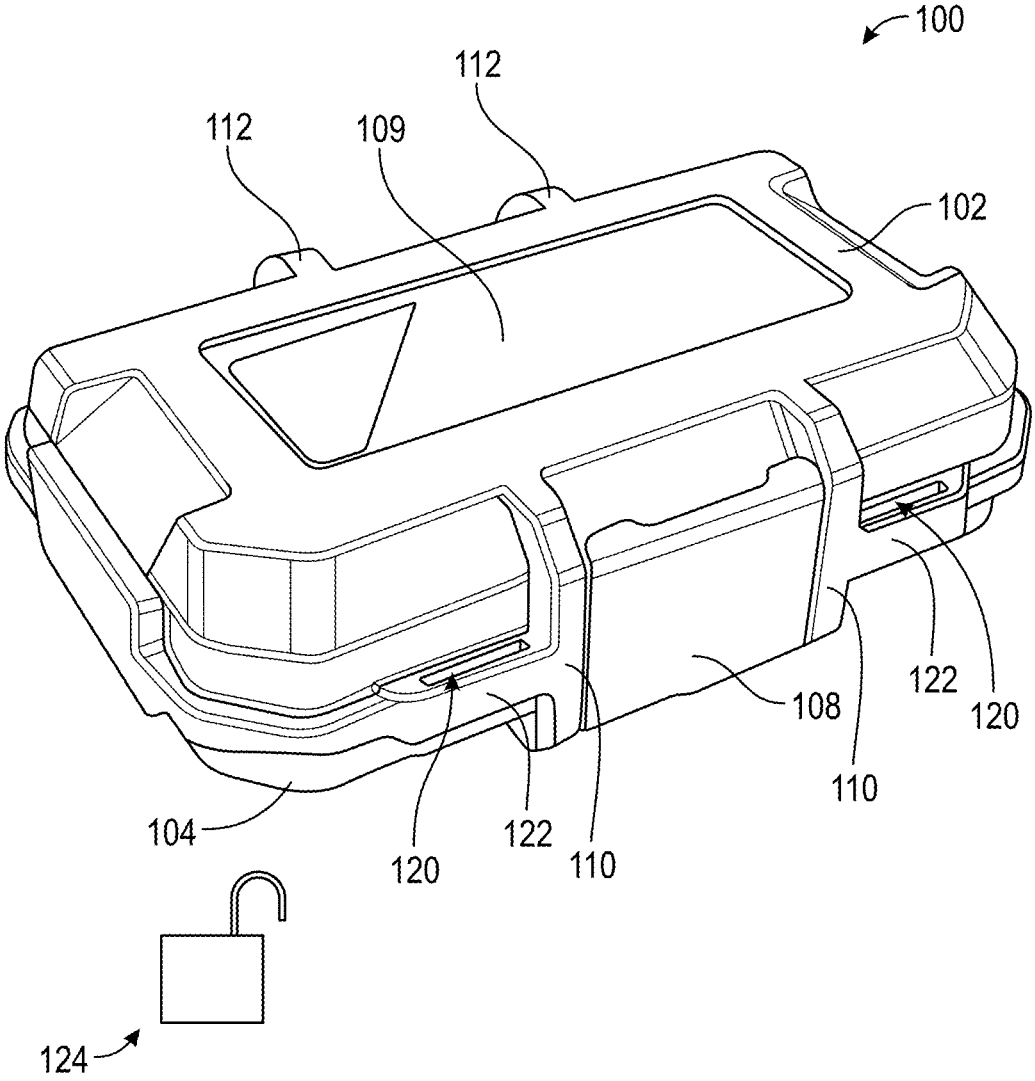
FIG. 1 illustrates a perspective view of a drivable component case according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Figure 5:
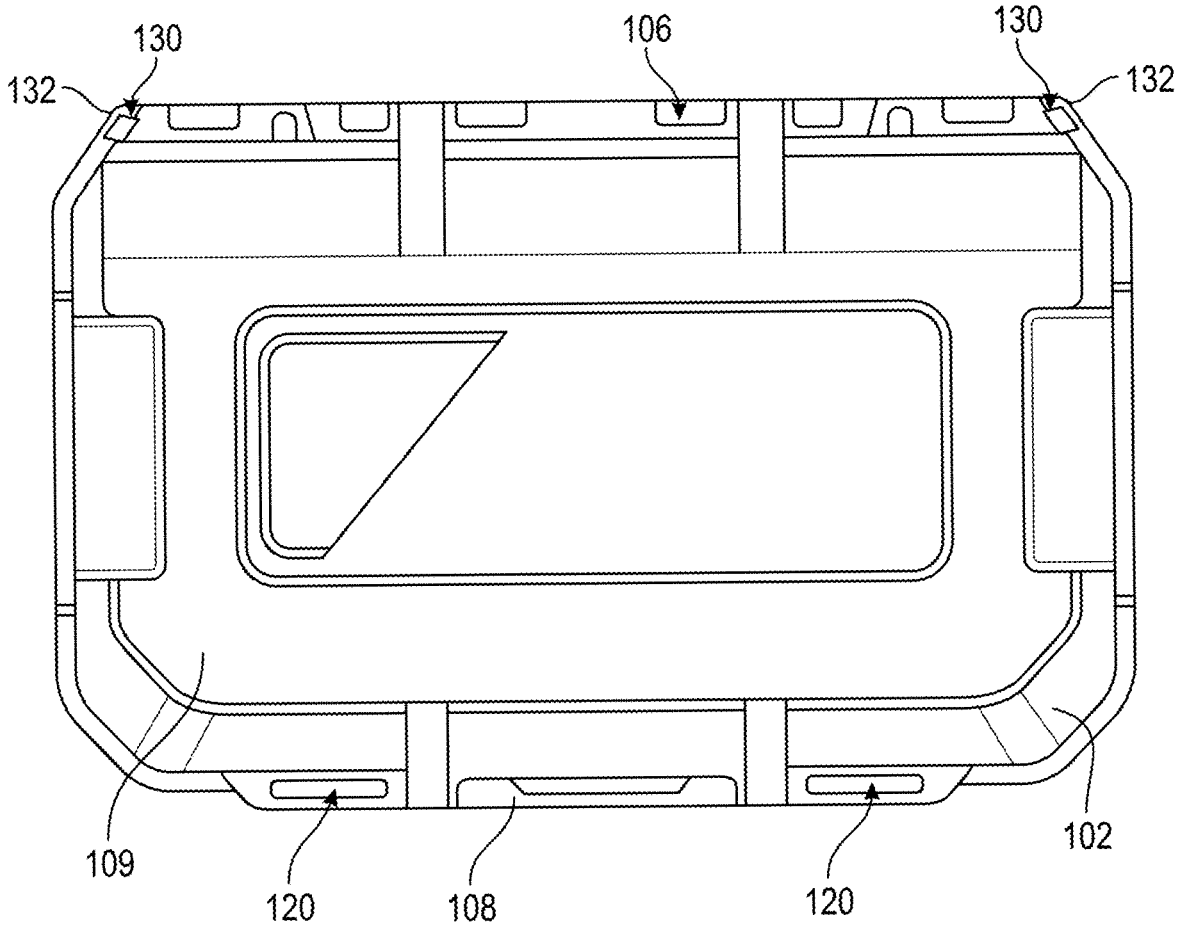
FIG. 5 illustrates a top view of a version of the case having two attachment loops according to an example embodiment.

As indicated above, some example embodiments may relate to the provision of an improved tool accessory case design. In this regard, for example, the case may be designed to enable transport or suspension of the case, while still allowing access to the inside of the case. To accomplish this improvement, a case attachment loop is provided to be integrated into an advantageous location of the case. For example, the case attachment loop may be provided proximate to (and in some cases along an axis of) the hinge of the case. As such, the case can be suspended at the case attachment loop and still freely open and close. Moreover, in some cases, the case can be latched and/or locked via a latching mechanism and/or one or more locking loops disposed at an opposite side of the case. Such a case in accordance with an example embodiment will now be described in reference to FIGS. 1-4, which illustrate one physical structure of a working example described above. FIG. 5 illustrates a slight modification on the example of FIGS. 1-4.

Figure 2:
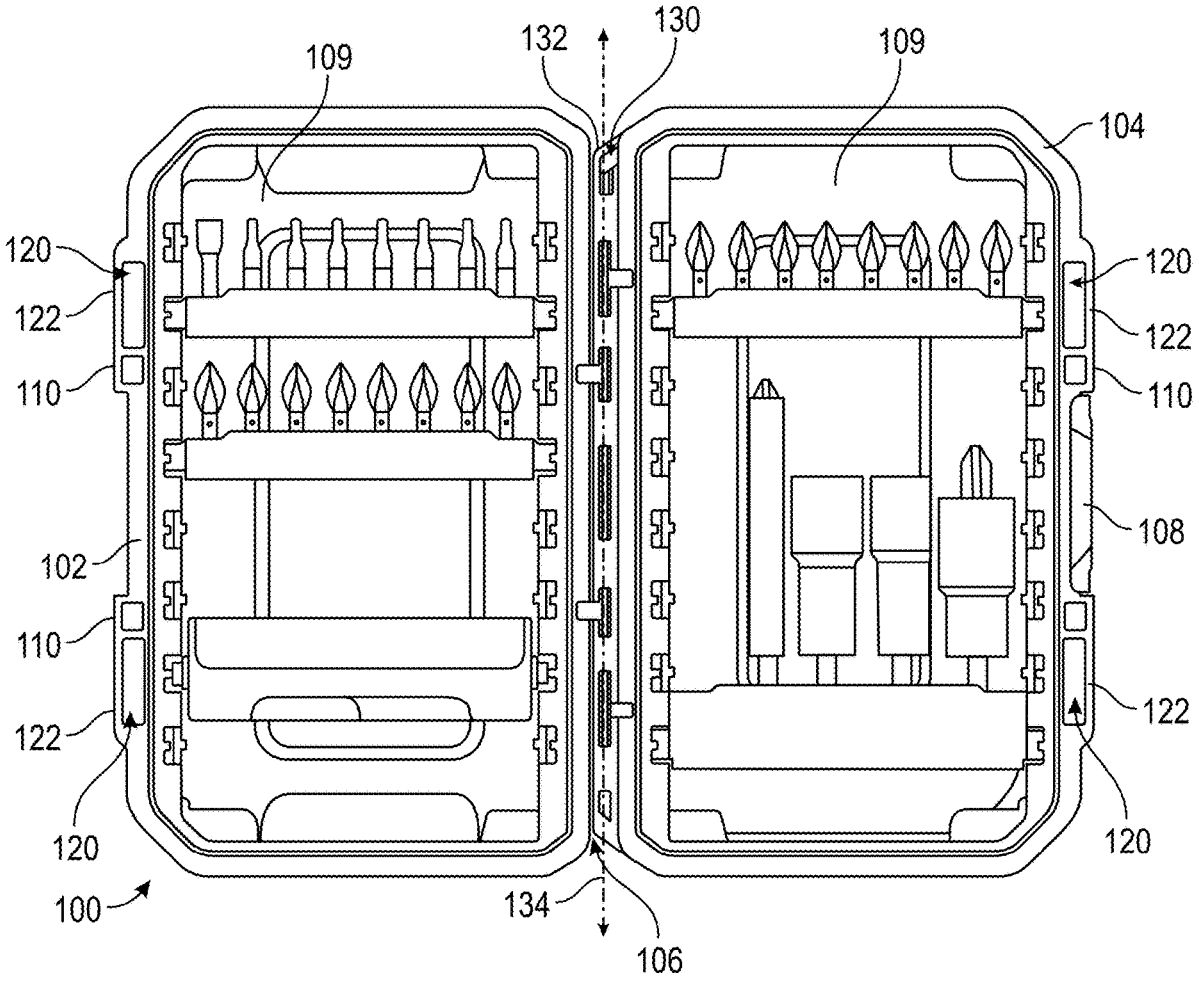
FIG. 2 illustrates top view of the case of FIG. 1 in an opened state according to an example embodiment.

FIG. 1 illustrates a perspective view of a drivable component case 100 according to an example embodiment, and FIG. 2 illustrates the case opened up so that inner portions thereof are visible. As can be appreciated from FIGS. 1 and 2, the case 100 may include a first half shell 102 and a second half shell 104 that may be hingedly attached to each other via hinge 106. The first and second half shells 102 and 104 may each include a base portion 109 (i.e., forming a top wall and a rear wall, respectively) and four sidewalls that each extend perpendicularly away from the base portion 109

(and substantially perpendicular to adjacent ones of the sidewalls) to define a container portion in each respective one of the first and second half shells 102 and 104. When the first and second half shells 102 and 104 rotate about the hinge 106 toward each other, respective ones of the sidewalls of the first half shell 102 meet and align with the sidewalls of the second half shell 104 at distal edges thereof relative to their respective base portions 109. Meanwhile, the base portions 109 of each of the first and second half shells 102 and 104 will lie in parallel planes that are spaced apart from each other by the height of the case 100, when the case 100 is closed. When the case 100 is in the opened state, as shown in FIG. 2, the base portions 109 may be substantially in the same plane.

In an example embodiment, a latching mechanism 108 may be provided at sidewalls opposite the hinge 106 to enable the case 100 to be held in the closed position. The latching mechanism 108 may be pivotally connected to one of the first half shell 102 or the second half shell 104, and may alternately pivot away from and toward the other of the second half shell 104 or the first half shell 102. In the example of FIGS. 1 and 2, the latching mechanism 108 is pivotally attached to the second half shell 104 and pivots toward the first half shell 102 to make a snap connection therewith to latch the case 100 in the closed position.

In some examples, the latching mechanism 108 may include a ridged or textured outer surface to facilitate identification of the latching mechanism 108 by feel. Another feature that may facilitate location of the latching mechanism 108 by feel may be the provision of ribs 110 on opposite lateral sides of the latching mechanism 108. The ribs 110 may therefore be provided to extend substantially perpendicular to the axis about which the latching mechanism 108 pivots. As such, the ribs 110 extend from the base portion 109 of the second half shell 104 to the base portion 109 of the first half shell 102. Each of the ribs 110 is therefore composed of one portion that is integral to the first half shell 102 and one portion that is integral to the second half shell 104. The respective portions meet each other to form the ribs 110 when the case 100 is in the closed position. The ribs 110 may also enhance the aesthetic appearance of the case 100, may protect the latching mechanism 108, and may add further rigidity and robustness to the case 100.

In an example embodiment, a second set of ribs 112 may be provided at a side of the case 100 that is opposite the latching mechanism 108 (e.g., mirroring the ribs 110 about a longitudinal centerline of the case 100). The second set of ribs 112 may be spaced apart from each other by the same distance that separates the ribs 110 (i.e., the width of the latching mechanism 108). The second set of ribs 112 may therefore also be provided to extend substantially parallel to the ribs 110. As such, the second set of ribs 112 also extend from the base portion 109 of the second half shell 104 to the base portion 109 of the first half shell 102. Each of the second set of ribs 112 is therefore composed of one portion that is integral to the first half shell 102 and one portion that is integral to the second half shell 104. The respective portions meet each other to form the second set of ribs 112 when the case 100 is in the closed position. The second set of ribs 112 may also enhance the aesthetic appearance of the case 100 and add further rigidity and robustness to the case 100. The second set of ribs 112 may be proximate to, and extend across, the hinge 106.

Although the latching mechanism 108 is configured to enable the first and second half shells 102 and 104 to be held together in the closed position to facilitate storage and/or transfer of the case 100 and its contents without any of the contents being able to fall out of the case 100, the latching mechanism 108 is relatively easy to operate by hand and otherwise does not offer addition security for the contents of the case 100. For additional security, the case 100 may be provided with one or more locking loops 120 disposed proximate to the latching mechanism 108 and/or the ribs 110. The locking loops 120 may be formed by rib extensions 122 that extend perpendicularly away from the ribs 110 (and the latching mechanism 108) to form the locking loops 120.

The rib extensions 122 of some embodiments may extend away from the sidewalls of the case 100 by the same amount as the ribs 110. Thus, the ribs 110 and rib extensions 122 may each be flush with each other with respect to their extension away from the sidewalls of the case 100. Moreover, the latching mechanism 108 may also (when latched) be flush or substantially flush with the ribs 110. The ribs 110 and rib extensions 122 may form a "T" shape with the ribs 110 forming the top of the T and the rib extensions 122 forming the base of the T.

As can be appreciated from FIG. 2, the rib extensions 122 (like the ribs 110) are each formed to extend across both the first and second half shells 102 and 104. In other words, one portion of each of the rib extensions 122 is integrally formed in the first half shell 102 and another portion of each of the rib extensions 122 is integrally formed in the second half shell 104. When the case 100 is in the closed position, the respective portions of each of the rib extensions 122 meet each other to form the locking loops 120. Given that a portion of each of the rib extensions 122 is integrally formed in each of the first and second half shells 102 and 104, the passage of a locking device 124 through the locking loops 120 will necessarily bind or lock the first and second half shells 102 and 104 together. For example, a pad lock or other such locking device can be passed through one or both of the locking loops 120 and prevent opening of the case 100 even though the latching mechanism 108 may otherwise be free to operate.

In some cases, a worker may wish to transport or otherwise suspend the case 100 (e.g., on a belt using a carabiner or tether, or on a hook on a wall or work bench). If the worker suspended the case 100 via the locking loops 120, the case 100 could not be opened (assuming the case 100 was in the closed state initially upon suspension) or could not be closed (if the case 100 was open initially upon suspension). Thus, using the locking loops 120 to suspend or transport the case 100 necessarily prevents any possible state change (between the open and closed states) due to the integral nature of the respective portions of the rib extensions 122 and their correspondence to each other in the closed state. In this regard, if the carabiner, hook or tether is passed through only the locking loop 120 portion that is on the first half shell 102 when the case 100 is in the opened state, then the rib extension 122 on the second half shell 104 will not be able to be brought into contact with the rib extension 122 on the first half shell 102 due to the interposition of the carabiner, hook or tether therebetween. The case 100 cannot therefore be transitioned to the closed state. Conversely, if the carabiner, hook or tether is passed through the locking loop 120 such that it encompasses the rib extensions on both the first and second half shells 102 and 104 when the case 100 is in the closed state, then the carabiner, hook or tether will also continue to hold the first and second half shells 102 and 104 together so that the case 100 cannot be transitioned to the opened state. This inability to perform a state transition during suspension or transport via the locking loops 120 renders the locking loops 120 highly disadvantageous (and perhaps unsuitable) for use in suspension or transport.

To cure this deficiency, some example embodiments may include a case attachment loop 130 on a portion of the case 100. The case attachment loop 130 may be formed by providing an arm member 132 to extend off of a portion of the case 100 and return to a different portion of the case 100 to form the case attachment loop 130. In particular, the arm member 132 may extend off a portion of only one of either the first half shell 102 or the second half shell 104 and return to contact a different portion of the same one from which it extended. Thus, as shown in FIG. 2, the arm member 132 is provided only on the second half shell 104. However, it should be appreciated that the arm member 132 could alternatively only extend off of the first half shell 102. In either example, the formation of the case attachment loop 130 as a structure that only exists on one of the half shells of the case 100 means that the case 100 could be suspended (e.g., via a carabiner, tether or hook) without interference with the capability of a user to transition between the opened and closed states. As such, the problem discussed above can be overcome entirely merely by placing the case attachment loop 130 on only one half shell.

Although the case attachment loop 130 is useful merely by virtue of the fact that it allows state transition during suspension or transport of the case 100, some embodiments may further advantageously locate the case attachment loop 130 in order to further enhance the utility of the case 100. In particular, placing the case attachment loop 130 on only one half shell could theoretically be accomplished at any location on one of the half shells by merely forming the case attachment loop 130 to protrude or extend off of the distal end of one of the sidewalls (or another portion for that matter). However, picking any random location for the case attachment loop 130 may leave the case attachment loop 130 vulnerable to impact and breakage or otherwise interfere with the transition from the opened state to the closed state, or usability of the case 100 after opening. To prevent awkward or less than ideal operation of the case 100 upon opening while suspended, in some cases, the case attachment loop 130 may for example be formed to lie along an axis 134 of the hinge 106. Moreover, the case attachment loop 130 may be disposed proximate to one longitudinal end of the hinge 106 as shown in FIG. 2. In this regard, the end of the hinge 106 may be chosen as the top end of the case 100 relative to the contents located inside. However, in some embodiments, more than one instance of the case attachment loop 130 may be provided, and each such instance may be disposed at opposing longitudinal ends of the hinge 106 as shown in FIG. 5. This may be useful, for example, in a case where the contents can be oriented in more than one (or even variable) directions. Thus, the case 100 may be suspended with either end acting as the top end dependent upon the orientation of the contents inside the case 100. In some cases, in order to support placement of the case attachment loop 130 in-line with the hinge 106 without extending a length of the hinge 106 and case attachment loop 130 combined to a length longer than the length of the side of the case 100, the hinge 106 may be shorter than the length of the case 100. For example, the length of the hinge 106 may be less than 90% of the length of the first side of the case 100.

Placing the case attachment loop 130 along the axis 134 of the hinge 106 allows the case 100 to remain relatively balanced when suspended by the case attachment loop 130 in the opened state. For example, when opened as shown in FIG. 2, the case 100 could be hung from a hook and retain balance so that access to the contents (e.g., bits, drivers, sockets, or other accessories) can be provided even while the case 100 is suspended. Moreover, the case 100 can be transitioned from the closed state to the opened state while a suspending device 136 (e.g., a hook, tether or carabiner) that suspends the case 100 remains engaged with the case attachment loop 130 since the case attachment loop 130 is only integrated into the second half shell 104. This method of locating the case attachment loop 130 on the case may therefore overcome any awkward or unbalanced condition after the case 100 is opened and suspended by the case attachment loop 130. However, yet further design enhancements may also address the potential for vulnerability to damage or breakage.

Figure 3:
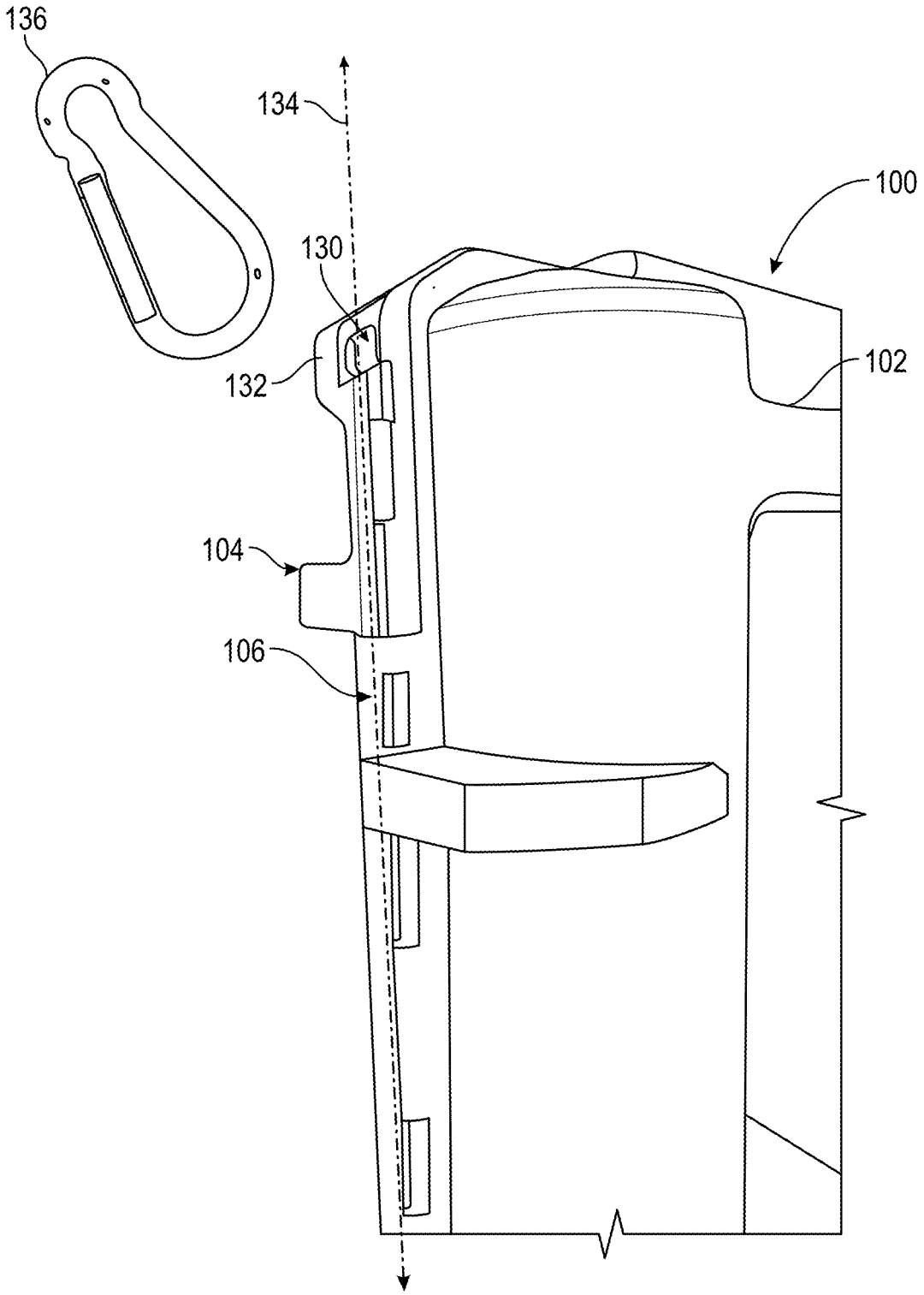
FIG. 3 illustrates a top perspective view of an attachment loop of the case according to an example embodiment.
Figure 4:
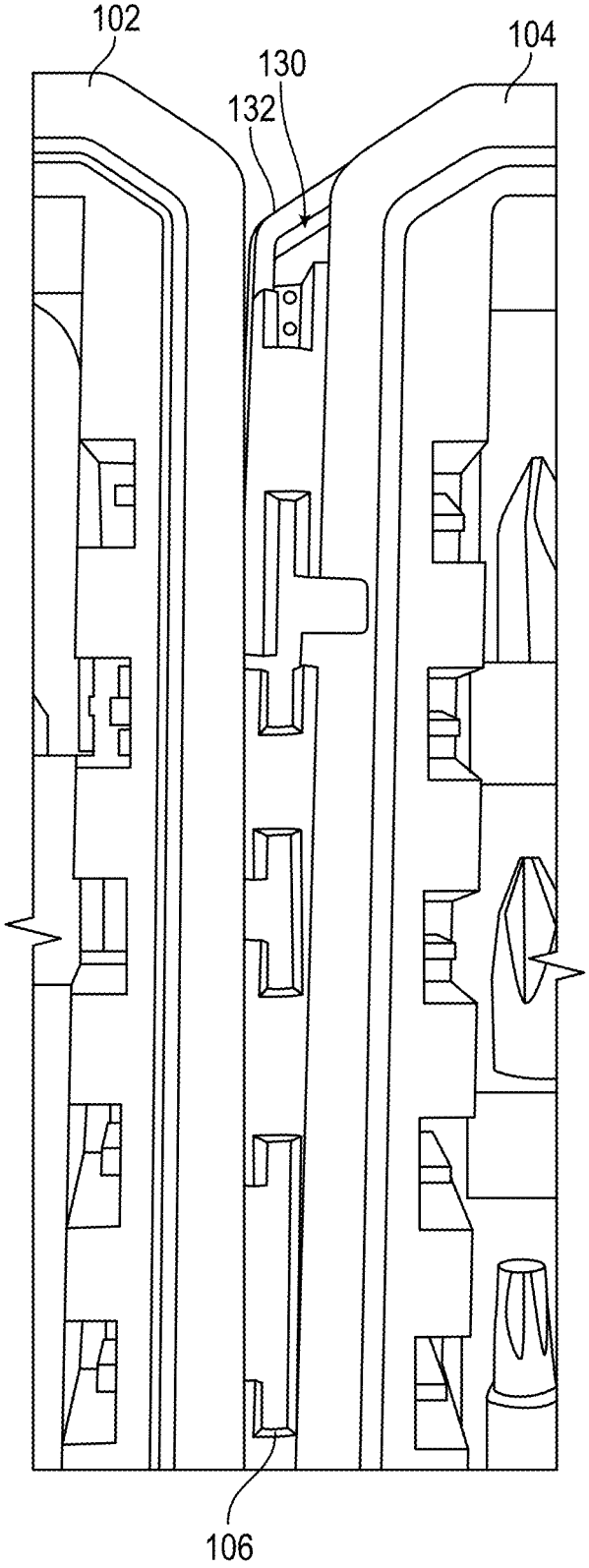
FIG. 4 illustrates a view of the attachment loop of the case while the case is open according to an example embodiment.

In this regard, for example, in some cases, the arm member 132 may be formed to be conformal with a transition between the hinge 106 and the sidewall of the case 100. In this regard, as shown best in FIG. 4, the sidewalls of the case 100 may meet at a tapered intersection 200. The tapered intersection 200 may be angled toward the hinge (e.g., at about 45 degrees relative to each sidewall in this example). The arm member 132 may extend conformal with the tapered intersection 200 to intersect with a portion of the hinge 106. This structure essentially tucks the case attachment loop 130 into a valley or V shaped crevice that is formed between the tapered intersections 200 of each of the first and second half shells 102 and 104 when the case 100 is in the opened state. Thus, the case attachment loop 130 is both centered for balance, but also effectively hidden in a protected location. Moreover, even when the case 100 is in the closed state (as shown in FIG. 3), the case attachment loop 130 has minimal exposure or protrusion away from the container portions or sidewalls of the case 100.

The container portion of each of the first and second half shells 102 and 104 may be configured to receive a frame member or frame. The frame members of each of the first and second half shells 102 and 104 may be configured to snap fit or otherwise removably and/or rotatably retain rails or other accessories. The rails may include enclosures for securing bits, drivers, sockets, etc. that may be accessible when the case 100 is in the opened state.

Accordingly, some example embodiments may provide a case for storing drivable components or tool accessories. The case may include a first half shell configured to retain drivable components or tool accessories, a second half shell, a hinge and an arm member. The hinge may operably couple the first half shell to the second half shell to enable the first and second half shells to pivot about an axis of the hinge to transition the case between an opened state and a closed state. The arm member may extend away from a portion of only one of the first or second half shell to form a case attachment loop. The case attachment loop may be disposed to enable the transition between the opened and closed states while a suspending device is passed through the case attachment loop.

The case described above may be augmented or modified by altering individual features mentioned above or adding optional features. The augmentations or modifications may be performed in any combination and in any order. For example, in some cases, the case attachment loop may be disposed along the axis of the hinge at one longitudinal end of the hinge. In an example embodiment, a second arm member may form a second case attachment loop along the axis of the hinge at an opposing longitudinal end of the hinge. In an example embodiment, the case attachment loop may be integrally formed into the one of the first or second half shell to be conformal with a transition between the hinge and a sidewall of the case. In an example embodiment, the first half shell and the second half shell may each include a base portion and sidewalls extending substantially perpendicularly away from the base portion, and a tapered intersection may be formed between sidewalls adjacent to the hinge, where the tapered intersection is angled toward the hinge. In an example embodiment, the case attachment loop may be integrally formed into the one of the first or second half shell to be conformal with the tapered intersection. In some situations, the arm member may extend conformal with the tapered intersection to intersect with a portion of the hinge. In an example embodiment, the tapered intersection may form about a 45 degree angle relative to each of the sidewalls. In some situations, the case attachment loop may be disposed in a V shaped crevice formed between the tapered intersection of each of the first and second half shells when the case is in the opened state. In an example embodiment, the one of the first or second half shell may be pivotally coupled to a latching mechanism that engages the other of the first or second half shell in the closed state. In an example embodiment, the case may further include ribs extending along lateral sides of the latching mechanism and substantially flush with the latching mechanism. In an example embodiment, the case may further include rib extensions forming respective locking loops on each opposing side of the latching mechanism. In some situations, the case further includes a second set of ribs mirroring the ribs about a longitudinal centerline of the case. In an example embodiment, the rib extensions may be flush with the latching mechanism and the ribs. In an example embodiment, the rib extensions may combine with the ribs for form a T shape with the locking loops being formed at a base of the T shape. In an example embodiment, the case may further include one or more locking loops formed at a side of each of the first and second half shells that is opposite the hinge. In some examples, the locking loops may be configured such that a locking device passing through the locking loops prevents a transition between the opened state and the closed state. In an example embodiment, the locking loops may be formed by rib extensions that are integrally formed in each of the first and second half shells. In some cases, the length of the hinge may be less than 90% of the length of the first side.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A case for storing drivable components or tool accessories, the case comprising:

a first half shell configured to retain drivable components or tool accessories;

a second half shell;

a hinge operably coupling the first half shell to the second half shell to enable the first and second half shells to pivot about an axis of the hinge to transition the case between an opened state and a closed state; and an arm member extending away from a portion of only one of the first or second half shell to form a case attachment loop, wherein the case attachment loop is disposed to enable the transition between the opened and closed states while a suspending device is passed through the case attachment loop, wherein the case attachment loop is integrally formed into the one of the first or second half shell to be conformal with a transition between the hinge and a sidewall of the case, wherein the first half shell and the second half shell each include a base portion and sidewalls extending substantially perpendicularly away from the base portion, wherein a tapered intersection is formed between sidewalls adjacent to the hinge, the tapered intersection being angled toward the hinge, and wherein the case attachment loop is integrally formed into the one of the first or second half shell to be conformal with the tapered intersection.

2. The case of claim 1, wherein the case attachment loop is disposed along the axis of the hinge at one longitudinal end of the hinge.

3. The case of claim 2, wherein a second arm member forms a second case attachment loop along the axis of the hinge at an opposing longitudinal end of the hinge.

4. The case of claim 1, wherein the arm member extends conformal with the tapered intersection to intersect with a portion of the hinge.

5. The case of claim 4, wherein the tapered intersection forms about a 45 degree angle relative to each of the sidewalls.

6. The case of claim 5, wherein the case attachment loop is disposed in a V shaped crevice formed between the tapered intersection of each of the first and second half shells when the case is in the opened state.

7. The case of claim 1, further comprising one or more locking loops formed at a side of each of the first and second half shells that is opposite the hinge.

8. The case of claim 7, wherein the locking loops are configured such that a locking device passing through the locking loops prevents a transition between the opened state and the closed state.

9. The case of claim 8, wherein the locking loops are formed by rib extensions that are integrally formed in each of the first and second half shells.

10. A case for storing components, the case comprising:

a first half shell having a first side on an exterior portion of the first half shell;

a second half shell, at least one of the first half shell and the second half shell being configured to retain components;

a hinge operably coupling the first half shell to the second half shell to enable the first and second half shells to pivot about an axis of the hinge to transition the case between an opened state and a closed state, the hinge being disposed on the first side;

a case attachment loop coupled to or being integral with the first half shell, the case attachment loop being disposed on the first side;

wherein the case attachment loop is disposed at a first end of the first side and further wherein the length of the hinge is less than the length of the first side, wherein the case attachment loop is integrally formed into the one of the first or second half shell to be conformal with a transition between the hinge and a sidewall of the case, wherein the first half shell and the second half shell each include a base portion, sidewalls extending substantially perpendicularly away from the base portion, and a tapered intersection between consecutive sidewalls and adjacent to the hinge, wherein the tapered intersection forms about a 45 degree angle relative to each of the sidewalls and is angled toward the hinge, and wherein an arm member extends conformal with the tapered intersection and intersects with a portion of the hinge to form the case attachment loop.

11. The case of claim 10, further comprising a second case attachment loop coupled to or being integral with the first half shell, the second case attachment loop being disposed on a second end of the first side.

12. The case of claim 11, wherein the length of the hinge is less than 90% of the length of the first side.

13. The case of claim 10, wherein the one of the first or second half shell is pivotally coupled to a latching mechanism that engages the other of the first or second half shell in the closed state.

14. The case of claim 13, wherein the case further comprises ribs extending along lateral sides of the latching mechanism and substantially flush with the latching mechanism.

15. The case of claim 14, wherein the case further comprises rib extensions forming respective locking loops on each opposing side of the latching mechanism.

16. The case of claim 15, wherein the case further comprises a second set of ribs mirroring the ribs about a longitudinal centerline of the case.

17. The case of claim 14, wherein the rib extensions are flush with the latching mechanism and the ribs, and wherein the rib extensions combine with the ribs for form a T shape with the locking loops being formed at a base of the T shape.

* * * * *